US005091055A

United States Patent [19]

Fredenucci et al.

[11] Patent Number: 5,091,055

[45] Date of Patent: Feb. 25, 1992

[54] SHEET PREPARED BY WET MEANS AND USABLE AS A BACKING FOR A COVERING MATERIAL

[75] Inventors: Pierre Fredenucci; Jean-Bernard Berhaut, both of Charavines, France

[73] Assignee: Arjomari Europe, Paris, France

[21] Appl. No.: 569,767

[22] Filed: Aug. 22, 1990

Related U.S. Application Data

[63] Continuation of Ser. No. 286,162, Dec. 19, 1988, abandoned.

[30] Foreign Application Priority Data

Dec. 23, 1987 [FR] France ..... 87 18100

[51] Int. Cl.[5] ..... D21H 5/18

[52] U.S. Cl. ..... 162/135; 162/145; 162/146; 162/158; 162/160; 162/168.1; 162/175; 162/184; 428/281; 428/288

[58] Field of Search ..... 162/145, 146, 158, 168.1, 162/160, 175, 135, 184; 428/281, 288

[56] References Cited

U.S. PATENT DOCUMENTS

| | | | |
|---|---|---|---|
| 3,102,837 | 9/1963 | Griswold | 162/169 |
| 3,271,239 | 9/1966 | Hornbostel | 162/169 |
| 3,325,345 | 6/1967 | Hider | 162/169 |
| 3,573,158 | 3/1971 | Pall et al. | 162/146 X |
| 4,269,657 | 5/1981 | Gomez et al. | 162/135 |
| 4,451,539 | 5/1984 | Vallee et al. | 428/515 |
| 4,481,075 | 11/1984 | Dailly et al. | 162/146 X |
| 4,545,854 | 10/1985 | Gomez et al. | 162/135 |
| 4,645,565 | 2/1987 | Vallee et al. | 162/145 X |
| 4,734,321 | 3/1988 | Radvan et al. | 162/145 X |
| 4,789,430 | 12/1988 | Fredenucci | 162/145 |

OTHER PUBLICATIONS

Abstract Bulletin of the Institute of Paper Chemistry-vol. 55, No. 4 (Oct. 1984).

Abstract Bulletin of the Institute of Paper Chemistry-vol. 51, No. 5 (Nov. 1980).

*Primary Examiner*—David A. Simmons

*Assistant Examiner*—Thi Dang

*Attorney, Agent, or Firm*—Bacon & Thomas

[57] ABSTRACT

The invention relates to a sheet obtained by a papermaking process and usable as a product that can be substituted for conventional products referred to as impregnated glass covering products. The sheet essentially contains cellulose fibers, non-cellulose fibers, a thermoplastic powder of specified grain size, and a binder. It is optionally covered with a layer of plasticizer for the thermoplastic powder. Its resistance to traction-delamination increases with grain size. It is applicable as a backing, in particular to floor or wall coverings.

14 Claims, 1 Drawing Sheet

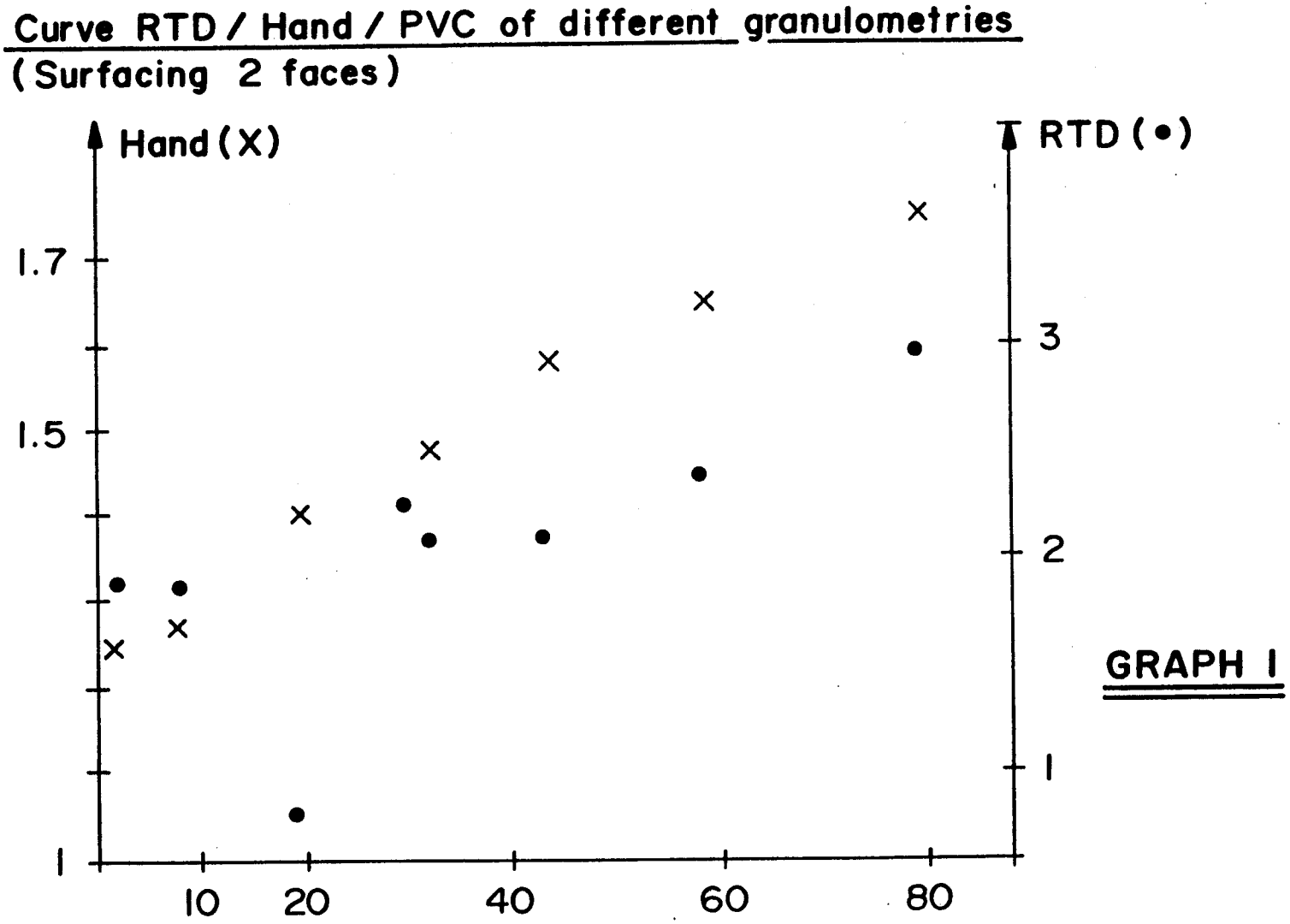
Curve RTD / Hand / PVC of different granulometries
(Surfacing 2 faces)
Hand (X)
RTD (•)
1.7
1.5
1
3
2
1
10
20
40
60
80
GRAPH I

SHEET PREPARED BY WET MEANS AND USABLE AS A BACKING FOR A COVERING MATERIAL

This application is a continuation of application Ser. No. 07/286,162, filed Dec. 19, 1988, now abandoned.

The invention relates to a sheet prepared by a papermaking process and usable as a substitute for impregnated glass covering products.

BACKGROUND OF THE INVENTION

Substitutes for glass covering products have already been proposed. The Applicants' French patent number 2 461 061 describes products obtained by making a sheet on a flat web papermaking machine or on a round mold papermaking machine by means of an aqueous composition, by removing the water from the sheet formed on the web in this way, and by drying it. The aqueous composition comprises:

cellulose fibers;
non-cellulose fibers;
at least one thermoplastic powder;
at least one binder; and
optionally fillers.

The flocculant may be a cationic agent, for example, which imparts positive charge to the cellulose fiber. According to the Applicants' European patent application number 79 400 405.1, the flocculating agent is added in two stages and improves retention of the fillers and of the thermoplastic powders.

The Applicants' French patent number 82 12319 describes a paper sheet whose dimensional stability is improved by adjusting the quantity of glass fibers. This publication proposes coating or impregnating the paper sheet obtained in this way with an aqueous composition containing, in particular, a plasticizer, thermoplastic powders, and an emulsifier. The coating is then subjected to heat treatment in order to obtain partial gelling of the thermoplastic powders. The user of a paper sheet impregnated in this way then deposits various compositions of thermoplastic material thereon in order to obtain a covering material, e.g. a floor covering or a wall covering.

Such paper sheets must have excellent physical characteristics.

The sheets must be able to withstand being passed through industrial ovens at high temperatures, in particular while the floor or wall coverings are being manufactured. It is therefore necessary for the paper sheets to withstand heat well.

For floor coverings it is also desirable to obtain covering backing sheets having high resistance to traction-delamination (RTD). If this parameter is not correct, the sheet may delaminate in its own thickness while being used.

Finally, for this same floor covering application, it is necessary to obtain products which are particularly stable, dimensionally.

For reasons of cost, it is desirable to obtain sheets which have as low a density as possible.

The invention seeks to solve these problems. The aim of the invention is thus to obtain a sheet by a papermaking process which is usable as a backing for manufacturing floor or wall coverings and which has the following physical properties:

satisfactory RTD, preferably greater than 300 N/m, and better still 500 N/m or more;

adequate thickness, greater than 350 micrometers (μm) and preferably greater than 450 μm or even 500 μm;

high bulk; and dimensional stability at high levels of humidity.

Finally, for unavoidable manufacturing considerations, adequate stiffness must be combined with these properties together with adequate sheet strength when hot since the sheet is intended to be covered with a plastic material and then subjected to heat.

The degree of dimensional stability under high humidity which is required for obtaining a product which is stable after being laid, i.e. without rolling or buckling, depends on the thickness and/or on the weight of the sheet. Thus, for a thick product having a thickness of 500 μm or greater, an elongation of 0.25% in the crosswise direction appears to be a limit which should not be exceeded.

The person skilled in the art is aware that these requirements are often mutually incompatible. Thus, the person skilled in the art expects that if the thickness of the sheet increases, then its resistance to traction delamination will decrease. It is easily understandable that thick paper board delaminates more easily than thin paper board. The term "paper board" is used to designate any sheet of paper having high weight, namely more than 200 grams per square meter ($g/m^2$).

SUMMARY OF THE INVENTION

Surprisingly and completely unexpectedly, the Applicant has observed that the grain size of the thermoplastic powder has an influence on the RTD, and that by using powders having a grain size which is large relative to the powders normally used in papermaking (maximum grain size 5 μm), RTD can be conserved while increasing the thickness of the sheet.

The invention thus relates to a new sheet prepared by a wet papermaking process and comprising cellulose fibers, non-cellulose fibers, at least one flocculant, at least one thermoplastic powder, at least one binder, and optionally fillers and additives.

According to the invention, thermoplastic powders are used having an average grain size lying in the range 25 μm to 60 μm. It is preferable to use polyvinyl chloride (PVC) powders obtained by polymerization in suspension with an average grain size lying in the range 25 μm to 60 μm. Better still, PVC powders are used obtained by polymerization in suspension with an average grain size lying in the range 25 μm to 50 μm.

Finally, stiffness and the hot traction property are improved when the coating or impregnating slip comprises an aqueous composition of a plasticizer mixed with an emulsifier and a starch which may optionally be modified.

BRIEF DESCRIPTION OF THE DRAWING

Examples of the invention are described below and reference is made to the sole figure of the accompanying drawing which a graph of paper characteristics as a function of PVC grain size. The description also refers to tables I to V which are grouped together immediately before the claims.

MORE DETAILED DESCRIPTION

The following description made with reference to a first series of examples shows how the invention can be implemented.

a) In a first stage, a paper-like sheet is made from an aqueous composition comprising the following basic mixture (with quantities being given in terms of dry weight):

| | |
|---|---|
| cellulose fibers: | 19.8 g |
| long fibers refined to 25° Schopper (SR) | |
| non-cellulose fibers: | 9.2 g |
| Owens Corning HW 618 glass fibers, | |
| 11 μm in diameter, 4.5 mm long | |
| first flocculant: | |
| Hercules KYMENE 260 polyamino-amide epoxy | 0.38 g |
| activated by caustic soda pellets | 0.095 g |
| powdered thermoplastic resin: | 61.2 g |
| Atcchem XP 105/01 PVC obtained by polymerization | |
| in suspension, average grain size 33 μm | |
| filler: | 6.8 g |
| Blancs Mineraux de Paris MO 47 calcium carbonate | |
| binder: | 10 g |
| Vinamul National latex type VINAML R 34297 | |
| terpolymer of ethylene, vinyl acetate and vinyl chloride | |

The mixture is diluted in the upstream circuits of the papermaking machine to the appropriate concentration for obtaining the desired weight.

Immediately before the head box, the following is added continuously:

| | |
|---|---|
| second flocculant: | 0.2% to 0.5% |
| Dow Chemical SEPARAN XD 8494 cationic | |
| polyacrylamide (with the % of this flocculant | |
| being expressed relative to the dry weight of | |
| substance arriving in the head box). | |

After passing over the wires of a Foudrinier papermaking machine, removing water, and drying in conventional manner, sheets are obtained having a weight of at least 220 g/m$^2$.

b) The sheet obtained in this way is then impregnated with a covering composition or coating slip by means of a size press. The coating slip may either be applied to only one of the faces of the sheet, or else it may be applied to both faces. When only one face is treated, it is preferable to impregnate the face which is intended to receive the covering layers that remain visible after laying. This impregnating operation may be performed either on an industrial papermaking machine or else on a laboratory size press.

Another implementation of the invention may be performed using the above-described procedure but with the following substances (with quantities being in terms of the dry weights of the substances used):

| | |
|---|---|
| cellulose fibers: | 19.8 g |
| long fibers refined to 25° Schopper | |
| non-cellulose fibers: | 11.5 g |
| Owens Corning HW 618 glass fibers, | |
| 11 μm in diameter, 3.2 mm long | |
| first flocculant: | 0.58 g |
| Bayer AG NADAVIN R LT | |
| polyamine/polyamine-epichlorhydrin | |
| powdered thermoplastic resin: | 61.2 g |
| Atochem Xp 105/01 PVC | |
| (average grain size 33 μm) | |
| filler: | 6.8 g |
| Blancs Mineraux de Paris MO 47 calcium carbonate | |
| binder: | 10 g |
| Vinamul National latex type VINAML R 34297 | |
| second flocculant: | 0.4% |
| Dow Chemical SEPARAN XD 8494 | |

Laboratory tests E 14.12.87 and E 15.12.87 and industrial test E 2137 correspond to the first mass composition. The coating slip whose composition is given in Table I was applied to one face only of the sheet.

Industrial test E 2145 corresponds to the second mass composition. The coating slip whose composition is given in Table I was applied to both faces of the sheet.

The results of these four tests are shown in Table I.

Hot traction strength was measured as follows: an Adamel-Lhomargy DY 22 apparatus was used having a 10 daN load cell, a recorder, and an Adamel-Lhomargy CE 02 heating enclosure.

The two jaws were placed inside the heating enclosure and the temperature was raised to the selected value (200° C.), test lengths of paper (140 mm ×15 mm) were rapidly inserted (5 seconds) between the two jaws at a separation of 100 mm, the sample was left at temperature for 2 minutes and then ruptured using the ISO 1924/1976 standard. Finally, the average of five measurements was taken.

Resistance to traction-delamination was measured as follows:

1) Theory 1.1 Both faces of the paper are covered with PVC in the form of a plastisol of a composition selected to be representative of the type of plastisol most commonly used in Europe. It comprises:

| | |
|---|---|
| PVC obtained by polymerization in emulsion | 100 |
| dioctylphthalate | 43% of resin (pcr) |
| butylbenzylphthalate | 22 pcr |
| carbonate | 30 pcr |
| stabilizer and expansion agent | 2 pcr to 5 pcr |

1.2 It is then gelled and expanded.

1.3 The delamination force is evaluated using a conventional apparatus.

2) Method 2.1 Covering and gelling.

Paper cut to a size of 16 cm ×20 cm (or greater).

PVC covering: 450 g/m$^2$ using a blade.

PVC gelling 2 minutes at 160° C. 2.2 Expansion.

The sample covered with PVC on both faces is maintained in a ventilated oven.

The treatment time at 200° C. is adjusted to obtain a uniform foam (about 2 minutes).

Cooling is performed for 5 minutes.

Two strips are cut having a width of 50 cm and a length of 20 cm to 25 cm.

2.3 Delamination.

Internal delamination of the paper is initiated by hand at each end of the sample.

The sample is placed between the two jaws of a traction apparatus.

The sample is kept horizontal while the apparatus is operated. Speed: 10 cm/min.

The traction force curve is recorded. The average value of this curve gives the resistance to traction-delamination (RTD).

This resistance is expressed in cN/cm. Bulk expressed in cm$^3$/g is obtained by dividing the thickness of the sheet by its weight.

Table I thus shows that it is possible to make a sheet using a papermaking technique and suitable for use as a backing having all of the physical properties sought by the invention.

Limits on the Range of Grain Sizes for the Thermoplastic Resin Powder

Various tests have been performed with poly(vinyl chlorides) having average grain sizes lying in the range 2 μm to 80 μm.

The basic composition of the sheet and the composition of the coating slip were the same as in test E 15.12.87. The coating slip was applied to both faces of the sheet at 70 g/m$^2$.

These various tests are mentioned in Table II.

FIG. 1 shows the variation in bulk and in RTD as a function of grain size.

Given the poor results (FIG. 1) observed for powders of grain sizes that are conventionally used in papermaking (grain size about 1 μm to 5 μm), and subsequent tests performed using powders having an average grain size of 20 μm, the person skilled in the art came to the conclusion that it was not possible to reach the desired physical objectives by using powders with an average grain size of more than 10 μm. There seemed no point in trying even larger grain sizes.

In contrast, the Applicant has overcome this unfavorable prejudice and has continued testing. Most surprisingly, it has been observed that by using powders with even larger grain sizes (average grain size not less than 25 μm) it is possible to return to useful physical characteristics, in particular with respect to RTD and bulk (see FIG. 1). The increase in bulk with powder grain size is, in addition, an economic advantage in that such products are sold on the basis of thickness.

However, an upper limit on the average grain size of the thermoplastic powder is imposed by the sheet becoming dusty. Such dust clogs the papermaking machine and also the equipment used for the operation of spreading the thermoplastic layers.

In practice, the Applicant has observed such dustiness for average grain sizes greater than 60 μm.

According to the invention, the average grain size of the thermoplastic powder should therefore lie in the range 25 μm to 60 μm and preferably in the range 25 μm to 50 μm.

Table II shows the grain sizes of powders as a function of the polymerization method.

Nature of the Thermoplastic Resin Powder

The above examples show that the invention can be performed using a homopolymer of vinyl chloride as the thermoplastic powder.

However, the nature of the thermoplastic powder should not be restricted to PVC homopolymer. It is clear that any polymer which develops a high binding power after melting and plastification or gelling could be suitable, and in particular copolymers of vinyl chloride and vinyl acetate; and terpolymers of vinyl chloride, vinyl acetate, and ethylene.

PVC powders that have already been plastified may also be suitable. These powders may be obtained from recycled PVC obtained by grinding PVC which has already been plastified, and is in the form of films, sheets, or tubes manufactured in various different ways.

Such pre-plastified PVC powders may also be taken from mixtures referred to as "wetblends" or "dryblends".

A "wetblend" may be used for performing the invention as follows (with quantities being given in terms of dry weight):

a) the following wetblend is prepared in advance:

| | |
|---|---|
| thermoplastic powder: | 100 g |
| ATOCHEM PVC XP 105/01 (grain size 33 μm) | |
| DOP plasticizer: | 40 g |
| PVC temperature stabilizer: | 1 g |
| (Ciba-Geigy IRGASTAB) | |
| dispersing agent: | 0.25 g |
| triethanolamine salt of phosphoric ester | |
| Gerland BLYCOSTAT NED | |

b) Then, a paper-like sheet was made as described above in the laboratory but with the thermoplastic powder being replaced by the mixture containing preplastified PVC (wetblend). An inorganic loading was not used in this example.

| | |
|---|---|
| cellulose fibers: | 19.8 g |
| long fibers refined to 25° SR | |
| non-cellulose fibers: | 9.2 g |
| Owens Corning HW 618 glass fibers, | |
| 11 μm in diameter, 4.5 mm long | |
| first flocculant: | 0.5 g |
| Bayer AG NADAVIN R LT | |
| preplastified PVC wetblend prepared in a): | 68 g |
| binder: | 10 g |
| Vinamul National latex type VINAML R 32522 | |
| a terpolymer of ethylene, vinyl acetate, | |
| and vinyl chloride | |
| second flocclant: | 0.2% to 0.5% |
| (added immediately before the head box) | |
| Dow Chemical SEPARAN XD 8494 | |

The physical characteristics of the sheet obtained in this way are given in Table III.

These results show that a powder of preplastified PVC having a grain size lying within the range specified by the invention can be suitable for manufacturing a sheet using papermaking techniques and in accordance with the invention.

Nature of the Plasticizer

The following may be used as the plasticizer: di(2-ethylhexyl) phthalate; dibutyl phthalate; benzyl butyl phthalate; dihexyl phthalate; diisononyl phthalate; tricresyl phosphate; or any other plasticizer conventionally used for transforming poly(vinyl chlorides).

The following examples summarized in Table IV illustrate the use of di(2-ethylhexyl) phthalate or DOP, butyl benzyl phthalate or BBP, and dibutyl phthalate or DBP.

The samples were made using the procedure described for the tests of Table I.

Each sample had the following composition by mass (with quantities expressed in terms of weights of dry matter):

| | |
|---|---|
| cellulose fibers: | 19.8 g |
| long fibers refined to 25° SR | |
| non-cellulose fibers: | 10 g |
| Owens Corning HW 618 glass fibers, | |
| 11 μm in diameter, 3.2 mm long | |
| first flocculant: | 0.58 g |
| Bayer AG NADAVIN R LT | |
| powdered thermoplastic resin: | 61.2 g |
| Atochem PVC XP 105/01 average grain size 33 μm | |
| filler: | 6.8 g |
| Blancs Mineraux de Paris MO 47 calcium carbonate | |
| binder: | 10 g |
| Vinamul National latex type VINAML R 34297 | |
| second flocculant: | 0.4% |
| Dow Chemical SEPARAN XD 8494 | |
| The composition of the coating slip applied to the sheet | |

-continued

| in a size press is as follows (with quantities being expressed in terms of weight of dry matter): | |
|---|---|
| plasticizer: see Table III | |
| stabilizer: | 4 g |
| STAVINOR B7 870 | |
| emulsifier: | 0.60 g |
| EMULGATOR WS | |
| starch: | 9 g |
| Societe des Produits du Mais AMISOL 5591 | |
| (baked at 90° C. in 25% water solution) | |

Nature of the Cellulose Fibers and Degree of Refining

Any cellulose fiber or mixture of cellulose fibers may be used in accordance with the invention.

For example the following may be used:

softwood pulp treated with caustic soda and bleached
softwood pulp treated with caustic soda and semi-bleached
softwood pulp treated with caustic soda and unbleached
softwood pulp treated with bisulfite and bleached
softwood pulp treated with bisulfite and unbleached
hardwood pulp treated with caustic soda and bleached
hardwood pulp treated with caustic soda and semi-bleached
unbleached mechanical pulp
bleached mechanical pulp
bleached chemical straw pulp
bleached chemical alpha pulp.

Given that a high degree of dimensional stability is needed for the intended application of the invention, it is preferable to use cellulose fibers which are refined relatively little, in particular to between 15° SR and 35° SR.

Nature of the Non-Cellulose Fibers

The non-cellulose fibers are organic or inorganic fibers. The following may be used, for example:

polyethylene fibers (preferably 0.8 mm to 1 mm long)
glass fibers (preferably 5 μm to 15 μm in diameter and 3 mm to 6 mm long)
calcium sulfate or acicular gypsum fibers (preferably 0.5 mm to 3 mm long)
polyester fibers (preferably 3 mm to 6 mm long)
binder fibers such as fibers of polyvinyl alcohol
polypropylene fibers (preferably 0.8 mm to 1 mm long)
rock wool (0.1 mm to 0.3 mm long)
polyamide fibers.

It is also possible to use a mixture of these fibers. The main function of the fibers is to impart dimensional stability to the backing when subjected to water and temperature variations, both properties being necessary for the intended applications.

It is preferable to use cut glass fibers with a diameter lying in the range 7 μm to 12 μm and a length lying in the range 3 mm to 6 mm.

Nature of the Flocculant

Suitable flocculants include the following, for example:

aluminum sulfate
aluminum polychloride (aluminum hydroxychloride)
calcium and sodium aluminate
a mixture of polyacrylic amide and polyacrylic acid
polyethyleneimine
a copolymer of acrylamide and β-methacryloxyethyltrimethylammonium sulfate
polyamine-epichlorhydrin and diamine-propylmethylamine resin
polyamine-epichlorhydin resin
polyamide-polamine-epichlorhydrin resin
cationic polyamide-polyamine resin
condensation products of aromatic sulfonic acids with formaldehyde
polyamino-amide epoxy pretreated with caustic soda
aluminum acetate
aluminum formiate
a mixture of aluminum formiate, sulfate, and acetate
aluminum chloride ($AlCl_3$)
cationic starch.

Nature of the Inorganic Filler

Fillers may optionally be added. Suitable loadings include the following, for example:

Talc: magnesium silicate complex—particles of 1 μm to 50 μm, preferably 2 μm to 50 μm. Specific weight 2.7 to 2.8.
Kaolin: aluminum hydrate silicate complex—particles of 1 μm to 50 μm, preferably 2 μm to 50 μm. Specific weight 2.58.
Natural calcium carbonate: particles of 1.5 μm to 50 μm, preferably 1.8 μm to 30 μm. Specific weight 2.7.
Precipated calcium carbonate: particles of 1.5 μm to 20 μm, preferably 2 μm to 20 μm. Specific weight 2.7.
Natural barium sulfate: particles of 2 μm to 50 μm. Specific weight about 4.4–4.5.
Precipated barium sulfate: particles of 2 μm to 20 μm. Specific weight about 4.35.
Diatom silica: particles of 2 μm to 50 μm. Specific weight about 2 to 2.3.
Satin white: calcium hydrate sulfoaluminate.
Natural calcium sulfate: particles of 2 μm to 50 μm. Specific weight about 2.32 to 2.96.
Hydrated alumina: particles of 2 μm to 50 μm.
Calcium and sodium aluminate: particles of 1 μm to 20 μm. Specific weight 2.2.
Sodium silico aluminate: particles of 1 μm to 20 μm. Specific weight about 2.12.
Rutile: titanium dioxide particles of 0.5 μm to 10 μm. Specific weight about 4.2.
Anatase: titanium dioxide particles of 0.5 μm to 10 μm. Specific weight about 3.9.
Magnesium hydroxide: particles of 2 μm to 50 μm.
Alumina hydroxide: particles of 2 μm to 50 μm.

Note. Specific weight is expressed in grams per milliliter (g/ml).

It is preferable to use calcium carbonate which imparts better hot strength to the sheet.

Nature of the Binder

Binders which can be used in accordance with the invention include the following, for example:

native starch, in particular maize starch
oxidized starch
enzyme-produced starch
carboxymethylcellulose
a copolymer containing acrylic and acrylonitril (latex) structural units
a polymer containing structural units of ethyl acrylate, acrylonitril, N-methylolacrylamide and butyl acrylate (latex)
a polymer including structural units of styrene and butadine (latex)
a polymer containing structural units of styrene and butadine and carboxyl groups (latex)

poly(vinyl chloride) (latex)
poly(vinyl acetate) (latex)
a terpolymer of vinyl acetate, vinyl chloride, and ethylene (latex).

It is preferable to chose latexes having vinyl or acrylic structural units, in particular the terpolymer of vinyl acetate, vinyl chloride, and ethylene.

Additives

It is also possible, in conventional manner, to use papermaking additives such as anti-foaming agents, dry strength agents, wet strength agents, anti-rotting agents, anti-oxidizing, dyes, fire retarding agents, etc. Conventionally used temperature stabilizers for polyvinyl chloride which are missible in the plasticizers or in water are suitable. It is preferable to use salts of barium and zinc.

Sheets obtained by a papermaking process in accordance with the invention are characterized by their basic composition which comprises:

5% to 30% dry weight of cellulose fibers, and preferably 12% to 25%;

1% to 16% dry weight of non-cellulose fibers, and preferably 6% to 12%;

35% to 75% dry weight of thermoplastic resin in the form of a powder, and preferably 45% to 65%; the average grain size lying in the range 25 μm to 60 μm, and preferably in the range 25 μm to 50 μm;

0% to 40% dry weight of inorganic loading and preferably 0% to 25%, and more particularly 5% to 16%;

0.1% to 3% dry weight of at least one binder, and preferably 4% to 10%; and 0.1% to 3% dry weight of at least a first flocculant and 0.1% to 0.6% of at least a second flocculant added immediately upstream from the head box, said two flocculants optionally being the same.

The flocculant density should be adjusted by the person skilled in the art. It depends on the quantity of substances used and in particular on the quantity of binder. The percentage of the second flocculant is given relative to the dry weight of the mass arriving at the head box. The sum of the above-mentioned percentages, apart from the percentage of second flocculant, should be equal to 100.

The composition of the covering or coating slip that may optionally be applied to the sheet in a size press is characterized by the following formula:

10 parts to 100 parts plasticizer per 100 parts of resin, (in this case thermoplastic powder), and preferably 20 parts to 60 parts, and more particularly 35 parts to 50 parts.

(There must be sufficient plasticizer to achieve complete plastification of the thermoplastic powder inserted in bulk.)

0.1 parts to 4 parts temperature stabilizer for the thermoplastic powder.

0 parts to 10 parts emulsifier with the quantity of emulsifier being adjusted by the person skilled in the art.

A binder at a quantity adjusted by the person skilled in the art and depending on how the slip is intended to be deposited on the sheet.

Optionally an inorganic loading.

The four following examples were performed by varying the ratio between the thermoplastic powder and the loading (Table V).

The bulk composition was as follows (with quantities being given in terms of dry weight):

| | |
|---|---|
| cellulose fibers: long fibers refined to 25° SR | 19.8 g |
| glass fibers: HW 617, 11 μm in diameter, 3.2 mm long | 11.5 g |
| first flocculant: NADAVIN (C) LT | 0.58 g |
| thermoplastic resin powder: PVC XP 105/01 | (see TABLE V) |
| filler: Blancs Mineraux de Paris BO 38 calcium carbonate | (see TABLE V) |
| binder: VINAMUL R 34297 latex | 10 g |
| second flocculant: SEPARAN XD 8494 | 0.34% to 0.39% |

The composition of the coating slip is the same as for tests 15.12.87.

The weight of the paper-like sheet obtained in accordance with the invention depends on its thickness and on its bulk composition, in particular on the grain size of the powder used, and also on whether a coating slip is deposited thereon. In any event it is not less than 200 g./m$^2$ for a thickness of 500 μm.

TABLE I

| Test Number | E 2137 | E 14.12.87 | E 15.12.87 | E 2145 |
|---|---|---|---|---|
| Industrial or Laboratory: | ind. | lab. | lab. | ind. |
| Composition of the covering: | | | | |
| DOP plasticizer (g) di-(2-ethylhexyl) phthalate | 100 | 100 | 55 | 60 |
| PVC stabilizer (g) M & T Chimie Stavinor BZ 870 based on barium/zinc salts | 6 | 6 | 3.6 | 4 |
| Emulsifier (g) Emulgator WS | | | 0.55 | 0.6 |
| Starch (g) (baked, 25% solution in water) Societe des Produits du Mais Amisol 5591 | | | 8 | 8.4 |
| Laid at: (g/m$^2$) | 110/120 | 110/120 | 55/60 | 70/75 |
| Physical characteristics: | | | | |
| Weight (g/m$^2$) | 333 | 342 | 284 | 331 |
| Thickness (μm) | 444 | 471 | 454 | 500 |
| Bulk (cm$^3$/g) | 1.33 | 1.37 | 1.37 | 1.51 |
| UTS 2 min, 200° C. lengthwise | 0.87 | 0.82 | 1.52 | 1.70 |
| Two face RTD (N/m) | 630 | 635 | 620 | 500 |
| After baking at 200° C. for 2 min | | | | |
| TABER stiffness | | | | |
| Lengthwise | 21 | 23 | 25 | 56 |
| Crosswise | 10 | 7 | 15 | 23 |
| PRUFBAU stability (*) | | | | |
| 65%-15% | 0.05 | 0.07 | 0.07 | 0.11 |
| 98%-15% | 0.11 | 0.15 | 0.16 | 0.22 |

(*) % differences in elongation of a test piece of paper cut crosswise, between 65% and 15% relative humidity and between 98% and 15% relative humidity.

TABLE II

| AVERAGE PVC GRAIN SIZE (μm) | TYPE OF PVC POLYMERIZATION | PVC POWDER REFERENCE |
|---|---|---|
| 2 | micro-suspension | Vinnol P70EN |
| 8 | emulsion | Atochem 8 |

TABLE II-continued

| AVERAGE PVC GRAIN SIZE (μm) | TYPE OF PVC POLYMERIZATION | PVC POWDER REFERENCE |
|---|---|---|
| 20 | emulsion | Huls P1342K |
| 33 | suspension | Atochem XP105/01 |
| 40 | suspension | Vinnol C65V |
| 44 | suspension | Solvay 266 SF |
| 55 | suspension | Vinnol C57M |
| 80 | bulk | Huls P2004K |

TABLE III

| | |
|---|---|
| Weight | 312 g/m$^2$ |
| Thickness | 542 μm |
| Bulk | 1.75 cm$^3$/g |
| Two-face RTD | 350 |
| TABER stiffness | |
| Lengthwise | 31 |
| Crosswise | 18 |
| PRUFBAU stability | |
| 65%-15% | 0.04 |
| 98%-15% | 0.08 |

TABLE IV

| PLASTICIZER | DOP | BBP | DBP |
|---|---|---|---|
| Quantity of plasticizer (g) | 61 | 62 | 62 |
| Weight (cm$^3$/g) | 343 | 351 | 337 |
| Bulk (cm$^3$/g) | 1.55 | 1.56 | 1.54 |
| Two-face RTD (N/m) | 405 | 350 | 350 |
| PRUFBAU stability (%) | | | |
| 65%-15% | 0.10 | 0.12 | 0.13 |
| 98%-15% | 0.20 | 0.22 | 0.24 |

TABLE V

| | | | | |
|---|---|---|---|---|
| PVC Powder (g) | 61.2 | 52.3 | 45.3 | 40.0 |
| (dry weight mass %) | 55.6 | 47.5 | 41.2 | 36.4 |
| $CaCO_3$ Filler (g) | 6.8 | 15.7 | 22.7 | 28.0 |
| (dry weight mass %) | 6.17 | 14.3 | 20.6 | 25.4 |
| Laid at | 70 g/m$^2$ to 75 g/m$^2$ on both faces | | | |
| Bulk (cm$^3$/g) | 1.56 | 1.51 | 1.47 | 1.44 |
| RTD (N/m) | 520 | 440 | 380 | 280 |

We claim:

1. A sheet usable as a backing for a covering material and having a resistance to traction-delamination greater than 300 N/m, prepared by a papermaking process using an aqueous composition whose mass comprises the following dry matter percentage by weight:

12% to 25% cellulose fibers refined to between 15°SR and 35°SR;

6% to 12% mineral fibers;

45% to 65% thermoplastic resin in the form of a powder whose average grain size is in the range 25 μm to 60 μm;

4% to 10% of at least one binder;

0.1% to 10% of at least one first flocculant; and from 0 to 25% of at least one inorganic filler;

with the total of the above components equaling 100%.

2. A sheet according to claim 1 containing 0.1 to 0.6% of at least one second flocculant, with this percentage being expressed relative to the dry weight of the composition of claim 1.

3. A sheet according to claim 1, wherein the thermoplastic powder has an average grain size in the range 25 μm to 50 μm.

4. A sheet according to claim 1, wherein the mineral fibers are glass fibers.

5. A sheet according to claim 1, wherein the thermoplastic powder is selected from polymers having a high content of vinyl chloride.

6. A sheet according to claim 3, wherein the thermoplastic powder has a high content of vinyl chloride and is selected from the group consisting of polyvinyl chloride which is optionally preplasticized and which is optionally recycled; a copolymer of vinyl chloride and vinyl acetate; and a terpolymer of vinyl chloride, vinyl acetate, and ethylene.

7. A sheet according to claim 3, wherein the thermoplastic powder is selected from polyvinyl chloride prepared by polymerization in suspension and having an average grain size lying in the range 25 μm to 50 μm.

8. The sheet of claim 1, wherein said sheet is covered on at least one face with an impregnating layer comprising at least one plasticizer for the thermoplastic powder.

9. A sheet according to claim 8, wherein the impregnation layer comprises:

at least one plasticizer for the thermoplastic powder;

at least one stabilizer for the thermoplastic powder;

at least one emulsifier;

at least one binder; and at least one inorganic filler.

10. A sheet according to claim 8, wherein the composition of the impregnation layer comprises per 100 parts of thermoplastic powder:

10 parts to 100 parts of at least one plasticizer;

0.1 parts to 4 parts of at least one stabilizer for the thermoplastic powder; and 0 parts to 10 parts at least one emulsifier.

11. A sheet according to claim 8, wherein the plasticizer is selected from the group consisting of tricresylphosphate and the following phthalates: di(2-ethylhexyl), dibutyl, benzyl butyl, dihexyl and diisononyl.

12. A sheet according to claim 9 wherein the binder is selected from the group consisting of starch, modified starch and oxidized starch.

13. A sheet according to claim 8, wherein the composition of the impregnation layer comprises per 100 parts of thermoplastic resin:

20 parts to 60 parts of at least one plasticizer;

0.1 parts to 4 parts of at least one stabilizer for the thermoplastic powder; and from 0 parts to 10 parts of at least one emulsifier.

14. A sheet according to claim 11, wherein the binder is selected from the group consisting of starch, modified starch and oxidized starch.

* * * * *